United States Patent [19]

Davis

[11] 4,009,593

[45] Mar. 1, 1977

[54] REFRIGRATED SALAD AND SALAD DRESSING DISPENSING APPARATUS

[75] Inventor: Gary A. Davis, Wichita, Kans.

[73] Assignee: Stevens-Lee Company, Minneapolis, Minn.

[22] Filed: Mar. 10, 1976

[21] Appl. No.: 665,543

[52] U.S. Cl. ..... 62/250; 62/252; 62/395; 222/146 C

[51] Int. Cl.[2] ..... A47F 3/04; B67D 5/62

[58] Field of Search ..... 62/395, 441, 256, 252, 62/250; 222/146 C

[56] References Cited

UNITED STATES PATENTS

| | | | |
|---|---|---|---|
| 2,476,491 | 7/1949 | Henderson | 62/250 |
| 2,631,438 | 3/1953 | Weber | 62/250 |

*Primary Examiner*—Stanley H. Tollberg
*Assistant Examiner*—Hadd Lane

[57] ABSTRACT

A refrigerated cabinet including a compartment for salad and another compartment for salad dressing, rendering both the salad and salad dressing easily accessible to the user, and dispensing means for the salad and salad dressing.

9 Claims, 5 Drawing Figures

47
48
45
46
140
150
141
11
143
149

15
11
14
10
32
18
53
52
29
20
31
16
26
23
22
30
57
25
34
24
35
27
17
37
66
39
48
47
46
59
55
51
38
45
54
40
41
58
56
42
50
43
12

REFRIGRATED SALAD AND SALAD DRESSING DISPENSING APPARATUS

BACKGROUND OF THE INVENTION

This invention relates to refrigeration apparatus, and more particularly to refrigerated apparatus for dispensing salad and salad dressing.

Heretofore, in restaurant and other food service operations, although salads have been displayed in cooled or refrigerated receptacles, nevertheless the salad dressings to be used with the salads are usually contained in non-refrigerated containers completely separated from the refrigerated salad. Accordingly, the non-refrigerated salad dressings soon become warm, and eventually rancid and spoiled. Furthermore, the separated locations of the salad and dressing occupy an unnecessary amount of floor space.

SUMMARY OF THE INVENTION

It is therefore an object of this invention to provide a refrigerated apparatus for containing a salad compartment and a salad dressing compartment in a central location for convenient accessibility, for cooling both the salad compartment and the salad dressing compartment, and for providing portion control to a considerable extent in the discharge of the salad and the salad dressing from the respective compartments.

Another object of this invention is to provide a refrigerated salad and salad dressing dispensing apparatus in which the salad compartment, the salad dressing compartment and the refrigeration system are all organized relatively compactly for occupation of a minimum of floor space.

More specifically, the apparatus includes an upright cabinet including a relatively large salad compartment in the upper portion of the cabinet, a refrigeration equipment compartment in the lower rear portion of the cabinet and the refrigerated salad dressing dispensing compartment in the lower front portion of the cabinet.

The upper salad compartment is adapted to receive a relatively upright salad container having a salad discharge opening in the bottom portion of the front wall of the container. The entire front portion of the salad compartment is open, but adapted to be opened and closed by a front door having a salad port in the lower portion thereof for registry with the discharge opening in the salad container. Both the salad port and the salad discharge opening are preferably covered by respective closures or doors. Furthermore, the salad portion preferably is in the form of a chute member projecting forward of the front door to provide a small space for supporting a portion of salad between the discharge opening of the salad container and the door of the salad port, the bulk of the salad being retained in the salad container within the salad compartment.

The salad dressing compartment preferably comprises an elongated, insulated and refrigerated well extending transversely across the front of the lower portion of the cabinet and immediately below the salad port. Supported within the well are a plurality of salad dressing containers, each of which may have a pump-type dispenser head for discharging metered amounts of the selected salad dressing.

DESCRIPTION OF THE PREFERRED EMBODIMENTS

Figures 1, 2, 3:
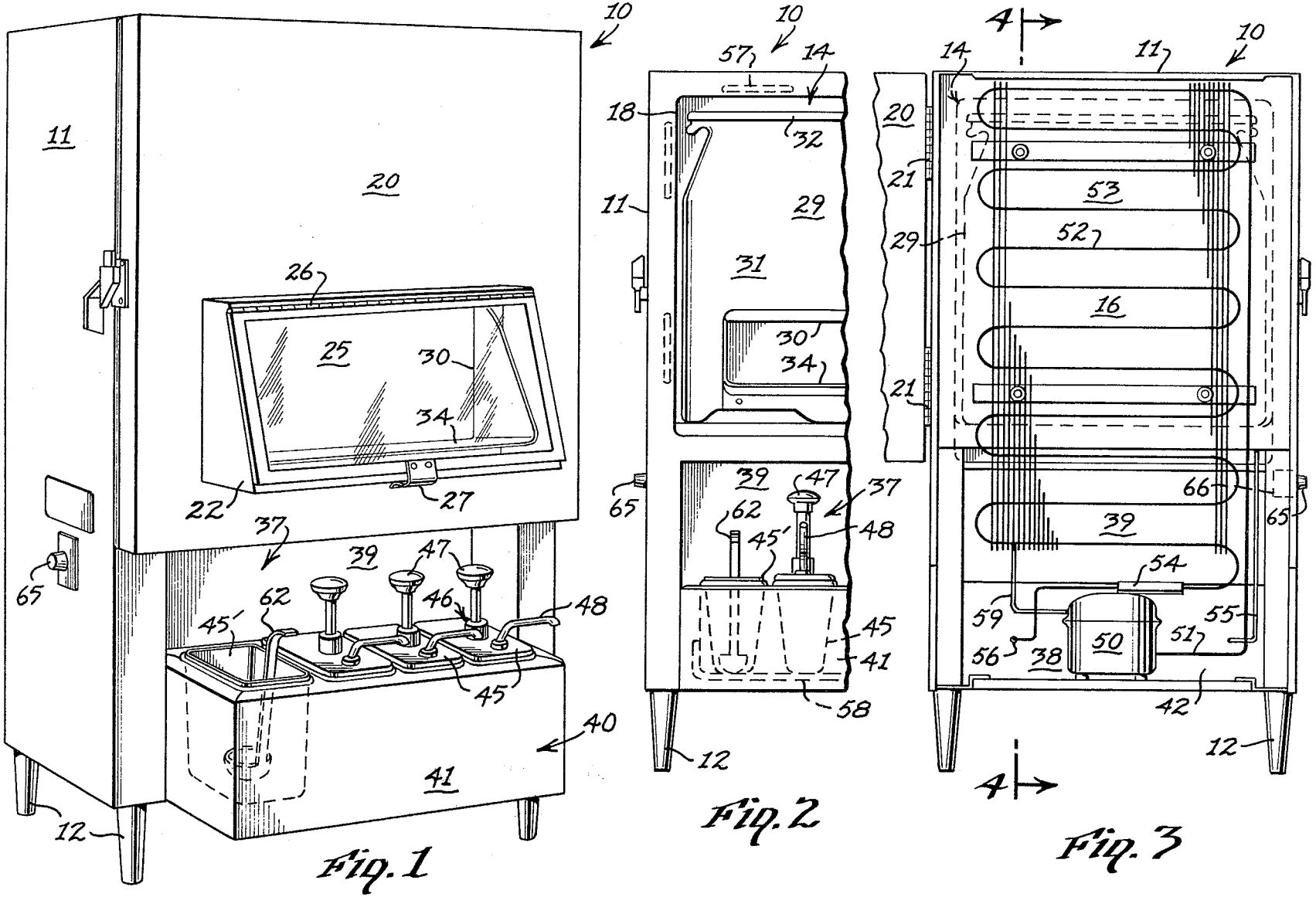
FIG. 1 is a front perspective view of the apparatus made in accordance with this invention.
FIG. 2 is a fragmentary front elevation of the apparatus slightly reduced, with the front door open.
FIG. 3 is a rear elevation of the apparatus with the front door open.

Referring now to the drawings in more detail, the refrigerating apparatus 10 includes a substantially upright cabinet 11 having legs 12 for supporting the cabinet 11 on a raised platform or table, not shown.

In the upper portion of the cabinet 11 is a salad compartment 14 having an insulated top wall 15, an insulated rear wall 16, an insulated bottom wall 17, and opposed insulated side walls 18. The entire front of the salad compartment is open and adapted to be closed by an insulated front door 20 connected to the compartment 14 by hinges 21.

The lower portion of the front door 20 is provided with a transverse salad port in the form of a chute member 22 which projects forward through the front door 20. The top wall 23 of the chute member 22 is slightly shorter than the bottom wall 24. The front opening of the chute member 22 is adapted to be opened and closed by a transparent port door 25 pivotally attached to the top wall 23 by hinges 26. The lower edge of the port door 25 is provided with a spring-biased latch 27, if desired.

Adapted to be received within the salad compartment 14 is an upright salad container or bin 29 adapted to receive the salad greens and other ingredients, and also adapted to substantially fill the salad compartment 14. A salad discharge opening 30 is disposed transversely through the front wall 31 of the salad container 29 and adapted to register with the chute member 22 of the salad port in the front door 20. The salad container 29 may be provided with an open top covered by a lid 32.

The discharge opening 30 may be provided with a chute-type closure 34, pivotally connected to the discharge opening 30 at the bottom thereof by hinges 35.

Figures 4, 5:
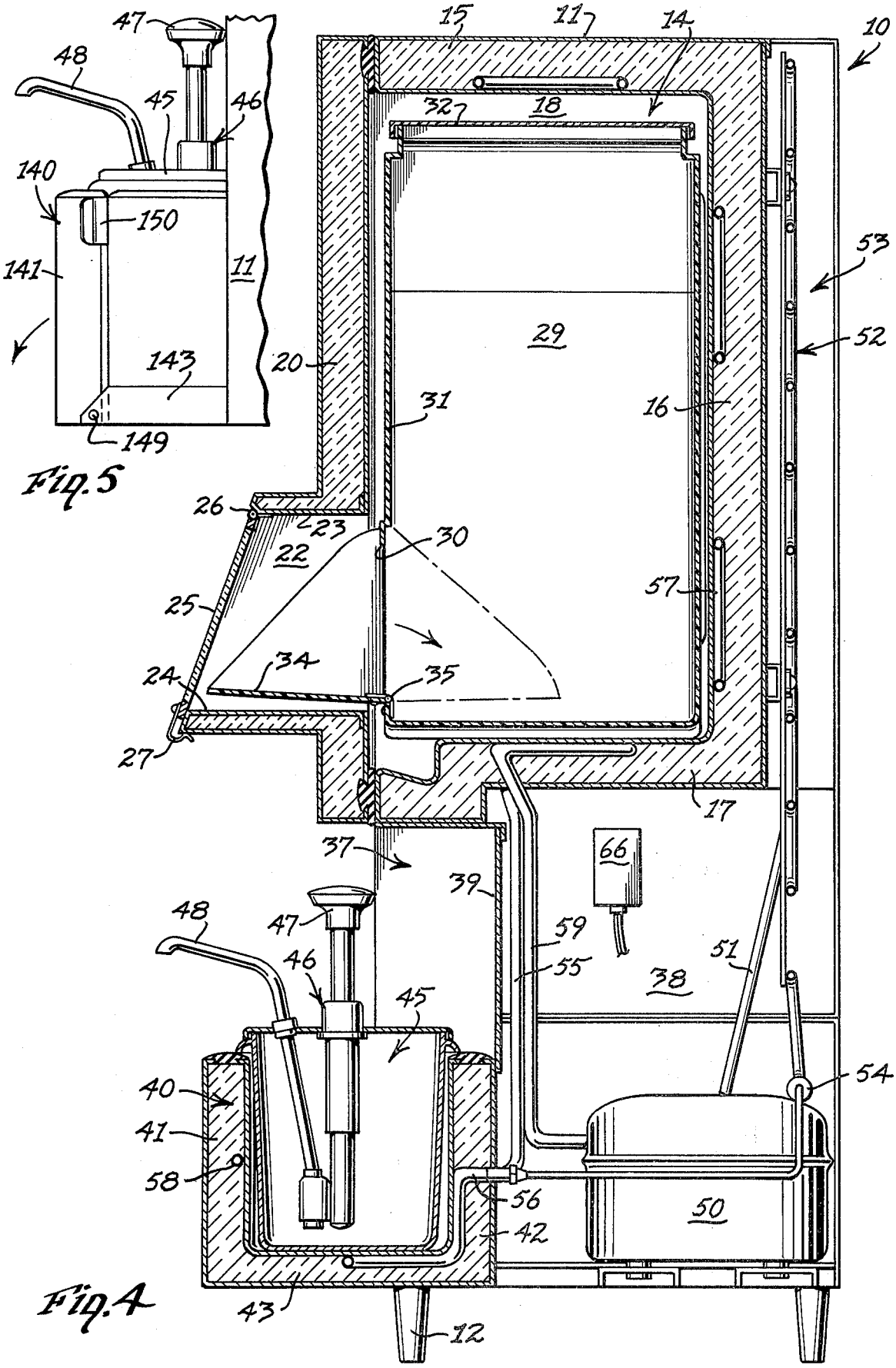
FIG. 4 is an enlarged sectional elevation taken along the line 4—4 of FIG. 3.
FIG. 5 is a fragmentary elevational view of a modified form of a salad dressing dispensing well.

When the salad container or bin 29 is filled with the salad and placed within the salad compartment 14, with its closure 34 in the solid-line, open position of FIG. 4, the salad ingredients will gravitate through the discharge opening 30 into the plenum or space within the chute member 22 to provide a small metered amount of salad accessible to the user when the transparent door 25 is opened. By having the bottom wall 24 longer or deeper than the top wall 23 and the transparent port door sloping upward and rearward, the salad ingredients received within the closed chute member 22 will tend to repose within the chute member, without spilling when the door 25 is opened.

Disposed in the front portion of the cabinet 11 below the bottom wall 17 is the salad dressing compartment 37, separated from the refrigeration apparatus compartment, or compressor compartment 38, by a vertical partition wall 39. A transverse well 40 having an insulated front wall 41, rear wall 42 and bottom wall 43, with an open top, occupies the lower portion of the salad dressing compartment 37. Mounted within the insulated well 40 are a plurality of salad dressing containers 45, each of which may contain a pump-type dispenser 46 having a manually operated plunger 47 and a dispensing spout 48. With the containers 45 filled with salad dressing, manual depression of the plungers 47 will discharge metered amounts of salad dressing from each spout 48, in a conventional manner, such as in the pump-type dispenser apparatuses employed in soda fountains. The well 40 may also contain salad dressing containers 45', each provided with a ladle 62 for dispensing the salad dressing, when desired.

In order to render the salad dressings more accessible to the user or consumer, the front wall 41 of the well 40 is spaced slightly forward of the front door 20. Furthermore, the well 40 is spaced substantially below the bottom wall 17 of the salad compartment 14 to permit sufficient space within the salad dressing compartment 37 for the hand of the consumer to operate the dispensing of the salad dressings with relative freedom from obstruction.

Mounted within the refrigeration equipment compartment 38 is a refrigeration compressor 50. Hot compressed refrigerant is supplied from the compressor 50 through the pipe 51 to the condenser coil 52 mounted in the condenser compartment 53 immediately behind the rear wall 16 of the salad compartment 14. The refigerant from he condenser 52 passes through the expansion valve 54 and thence through conduit 56 to the set of evaporator coils 58 in the walls of the salad dressing well 40, and then through conduit 55 to the second set of evaporator coils 57 within the walls of the salad compartment 14. The warm refrigerant is then returned through the line 59 to the compressor 50, to complete the conventional refrigeration cycle.

FIG. 5 discloses a modified type of well 140 in which the front wall 141 is hinged along its bottom edge by hinge pins 149 to the stationary bottom wall 143. The top portion of the front wall 141 is held in closed position against the side walls of the well 140 by spring-biased clamps 150. Otherwise, the construction of the well 140 is identical to the construction of the well 40. The walls of both wells 40 and 140 are insulated and refrigerated, and both support a plurality of the salad dressing containers 45 or 45'.

It will thus be seen that an appartus 10 has been designed which incorporates all the needs of the salad user, that is the salad ingredients and the variety of salad dressings, in a central location easily accessible to the user. Moreover, the salad compartment 14, salad dressing compartment 37 and the refrigeration equipment compartments 38 and 53, are compactly arranged, not only for the convenience of the salad user, but also to occupy a minimum of floor space.

Furthermore, the forwardly projecting salad dispensing chute 22, as well as the compartment 14 and the salad container 29, are so arranged as to automatically feed the salad in limited portions to the salad user with a minimum spillage. The salad dressings are also compactly and conveniently arranged below the salad compartment 14, enclosed within the containers 45 or 45', as well as being maintained in a constantly cooled condition available for dispensing in metered amounts to the salad user.

A temperature control knob 65 is mounted on the side wall of the cabinet 11, as disclosed in FIGS. 1, 2 and 3 for manual manipulation of the temperature controls within the casing 66 (FIG. 3) for regulating the cooling temperature within the salad compartment 14 and the salad dressing well 40.

What is claimed is:

1. A refrigerated apparatus for dispensing salad and salad dressing comprising:

a. a cabinet having front, rear, upper and lower portions, b. an insulated salad compartment in the upper portion of said cabinet having a front opening, c. a front door connected to said salad compartment for opening and closing said front opening, d. a salad port in the lower portion of said front door, e. a port door connected to said front door for opening and closing and said salad port, f. an insulated well extending transversely in the front portion of said cabinet, g. at least one salad dressing container in said well, h. means for dispensing salad dressing from each of said containers, i. a compressor compartment in the lower portion of said cabinet, j. a refrigeration system within said cabinet including a compressor, a condenser and first and second evaporators, k. said compressor being mounted in said compressor compartment, l. said condenser being mounted in the rear portion of said cabinet, m. said first evaporator being mounted in cooling relationship with said salad compartment, and n. said second evaporator being mounted in cooling relationship with said well.

2. The invention according to claim 1 further comprising a salad container adapted to be received within said salad compartment, a salad discharge opening in the lower portion of the front wall of said salad container registering with said salad port, when said front door is closed and said salad container is received within said salad compartment.

3. The invention according to claim 2 further comprising a closure for said salad opening in said salad container adapted to be moved between an open and a closed position.

4. The invention according to claim 1 in which said well is in the lower portion of said cabinet below said salad compartment and in front of said compressor compartment.

5. The invention according to claim 4 in which said salad compartment extends substantially the entire depth of said cabinet from front-to-rear, and both said well and said compressor compartment are located below said salad compartment.

6. The invention according to claim 5 further comprising a condenser compartment immediately behind said salad compartment for receiving said condenser.

7. The invention according to claim 4 in which said well projects slightly forward of said front door and said salad dressing containers are spaced substantially vertically below said salad port.

8. The invention according to claim 7 in which said salad port comprises a chute member projecting forward of said front door for receiving a portion of salad through said discharge opening from said salad container.

9. The invention according to claim 1 in which said means for dispensing salad dressing comprises a pump dispensing member for each container adapted to discharge metered amounts of salad dressing.

* * * * *